US009631398B1

(12) United States Patent
Liu

(10) Patent No.: US 9,631,398 B1
(45) Date of Patent: Apr. 25, 2017

(54) LOCK WITH A SLIDE FOR COVERING LOCK CORE AND POSITIONING DEVICE FOR THE SLIDE

(71) Applicant: FEDERAL LOCK CO., LTD., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 15/220,737

(22) Filed: Jul. 27, 2016

(51) Int. Cl.
*E05B 17/18* (2006.01)
*E05B 17/14* (2006.01)
*E05B 67/02* (2006.01)

(52) U.S. Cl.
CPC ..... *E05B 17/142* (2013.01); *E05B 17/185* (2013.01); *E05B 67/02* (2013.01); *E05B 17/18* (2013.01); *Y10T 70/7955* (2015.04); *Y10T 70/7977* (2015.04); *Y10T 70/8649* (2015.04)

(58) Field of Classification Search
CPC ..... E05B 17/142; E05B 17/185; E05B 67/02; E05B 17/18; E05B 17/14; Y10T 70/7955; Y10T 70/796; Y10T 70/7966; Y10T 70/7972; Y10T 70/7977; Y10T 70/7983; Y10T 70/8649
USPC ..... 70/54–56, DIG. 43, DIG. 56, 367–369, 70/371, 423–428, 455
See application file for complete search history.

(56) References Cited

U.S. PATENT DOCUMENTS 1,314,306 A * 8/1919 Cullison ..... B60K 15/04 220/816
1,369,506 A * 2/1921 Voight ..... E05B 17/183 70/455
1,517,924 A * 12/1924 Teich ..... E05B 17/185 70/455
1,741,093 A * 12/1929 Briggs ..... E05B 15/1614 411/517
1,904,882 A * 4/1933 Prior, Jr. ..... E05B 63/122 70/1.5
2,213,814 A * 9/1940 Jacobi ..... E05B 17/185 70/455
2,343,605 A * 3/1944 Solomon ..... B60K 15/0409 70/455
2,355,300 A * 8/1944 Johnstone ..... E05B 17/185 70/455
2,388,228 A * 10/1945 Johnstone ..... E05B 17/185 70/455
2,400,229 A * 5/1946 Freeman ..... E05B 17/185 70/379 R (Continued)

*Primary Examiner* — Lloyd Gall
(74) *Attorney, Agent, or Firm* — Rosenberg, Klein & Lee

(57) ABSTRACT

A lock includes a housing and a pivot is located in the insertion hole of the housing and has the first end thereof connected with a slide. A spring is received in the insertion hole, biases the second end of the pivot. When the slide is positioned at a close position, the slide is applied by the resilient force of the spring as to cover the installation recess so as to prevent dust and water from entering the core. When the slide is positioned at an open position, the slide is applied by a force to overcome the resilient force of the spring, and at least one portion of the slide does not cover the installation recess for convenience of unlocking the lock or replacement of the core. The housing includes a positioning member which positions the cover at open and close positions of the slide.

15 Claims, 9 Drawing Sheets

(56) References Cited

U.S. PATENT DOCUMENTS 2,439,978 A * 4/1948 Konchan ..... E05B 17/185 220/253
2,562,038 A * 7/1951 Jacobi ..... E05B 17/185 70/455
2,602,319 A * 7/1952 Jacobi ..... E05B 17/185 70/455
2,660,877 A * 12/1953 Malouf ..... B60K 15/0409 220/DIG. 33
2,702,468 A * 2/1955 Spain ..... E05B 17/185 70/455
2,733,831 A * 2/1956 Nehls ..... B60K 15/0409 220/302
2,931,209 A * 4/1960 Dies ..... E05B 17/185 70/455
3,422,643 A * 1/1969 Foote ..... E05B 67/02 70/371
3,898,824 A * 8/1975 Borlinghaus ..... E05B 17/185 70/423
3,930,391 A * 1/1976 Borlinghaus ..... E05B 17/185 70/455
4,192,161 A * 3/1980 Borlinghaus ..... E05B 17/185 70/452
4,290,279 A * 9/1981 Fish ..... E05B 67/24 70/367
4,545,223 A * 10/1985 Poutiainen ..... E05B 67/24 70/368
4,586,355 A * 5/1986 Lee ..... E05B 17/185 70/452
4,587,817 A * 5/1986 Self ..... E05B 15/1614 70/427
4,597,274 A * 7/1986 Coscia ..... E05B 17/185 70/452
4,674,308 A * 6/1987 Peters ..... E05B 17/185 70/423
4,723,428 A * 2/1988 Yamaguchi ..... E05B 17/185 70/423
4,881,391 A * 11/1989 Villa ..... E05B 17/185 70/423
5,572,890 A * 11/1996 Carpenter ..... E05B 15/1614 70/371
5,718,137 A * 2/1998 Huston ..... B62H 5/02 70/423
6,092,404 A * 7/2000 Chhatwal ..... E05B 47/00 70/278.1
6,272,890 B1 * 8/2001 Huston ..... B60R 25/021 70/423
6,408,661 B1 * 6/2002 Chen ..... E05B 67/36 70/226
7,225,651 B2 * 6/2007 Edwards ..... E05B 9/086 70/369
7,401,484 B1 * 7/2008 Holmes ..... E05B 13/10 292/336.3
7,591,159 B2 * 9/2009 Tsuchikiri ..... B60R 25/04 70/252
7,707,863 B2 * 5/2010 Tsuchikiri ..... B60R 25/04 70/252
7,735,347 B2 * 6/2010 Tsuchikiri ..... B60R 25/04 70/423
8,474,290 B2 * 7/2013 Terhaar ..... E05B 17/04 292/21
2008/0190157 A1 * 8/2008 Mizuno ..... E05B 17/183 70/455

* cited by examiner

LOCK WITH A SLIDE FOR COVERING LOCK CORE AND POSITIONING DEVICE FOR THE SLIDE

BACKGROUND OF THE INVENTION

1. Fields of the Invention

The present invention relates to a lock with a slide for covering the core thereof, and a positioning device for positioning the slide, and more particularly, to a slide for covering the installation recess of the lock.

2. Descriptions of Related Art

The conventional locks generally comprise a housing with a core located therein. A bead system is received in the core and includes multiple recesses and each recess receives multiple beads therein. In order to increase safety, resilient members and duplicate bead units are added in the bead system. The core has a keyhole in which a key can be inserted to arrange the beads to a unlock position so that the core can be rotated.

It is noted that the key hole is exposed and dust, moisture can easily enter the core to cause rusting to the parts in the core because most of the parts are made by metal. The rusted parts may affect rotation of the core. Besides, pebbles and sands may also enter into the core, and some parts in the core has lubricant attached thereto and the pebbles, sands and dust are easily attached to the lubricant to block the movement of the beads such that the lock is difficult to be locked or unlocked.

Furthermore, most of the locks are located outside of houses, such as paddle locks, door locks or vehicle locks, these locks can easily be affected by rain, dust, pebbles and sands and have to be replaced with a lot of money spent.

The present invention intends to provide a lock with a slide for covering the core thereof, and a positioning device for positioning the slide.

SUMMARY OF THE INVENTION

The present invention relates to a lock and comprises a housing having an insertion hole and an installation recess defined in the underside thereof. A pivot is located in the insertion hole and has the first end thereof connected with a slide. A spring has the first end thereof connected to the insertion hole, and the second end of the spring is connected to the second end of the pivot. The spring applies a resilient force along the pivoting direction of the slide. When the slide is positioned at a close position, the slide is applied by the resilient force of the spring so as to cover the installation recess. When the slide is positioned at an open position, the slide is applied by a force to overcome the resilient force of the spring, and at least one portion of the slide does not cover the installation recess.

Preferably, the spring has a first leg on the first end thereof, and the insertion hole has a side hole defined therein. The first leg is fixed in the side hole to fix the spring to the insertion hole.

Preferably, the spring has a second leg on the second end thereof, and the pivot has a slot defined in the second end thereof. The second leg is engaged with the slot to fix the spring to the pivot.

Preferably, a driving member is connected to the insertion hole from the top of the housing. The second end of the pivot is connected to the driving member so as to form a positioning hole between the pivot, the driving member and the slot of the pivot. The second leg is located in the positioning hole.

Preferably, the pivot has a flange extending radially therefrom. The flange is located close to the first end of the pivot. The cover contacts the underside of the flange.

Preferably, the pivot has a locking portion formed on the second end thereof. The driving member has a locking hole defined in the first end thereof. The locking portion is connected to the locking hole to connect the pivot to the driving member. The slot is defined axially through the locking portion.

Preferably, the slot is defined in at least one portion of the flange.

Preferably, the driving member has a notch defined in the second end thereof.

Preferably, the insertion hole has a support portion formed in the inside thereof. The support portion includes a through hole which communicates with the insertion hole. The driving member has a contact portion on the second end thereof. The contact portion contacts the support portion.

Preferably, the spring is a torsion spring.

Preferably, the housing has a protrusion protruding from the underside thereof, and the protrusion has a first end face. When the slide is positioned at the close position, one side of the slide contacts the first end face.

Preferably, the protrusion has a second end face which faces the first end face. When the slide is positioned at the open position, another side of the slide that is located opposite to the direction of the resilient force of the spring contacts the second end face.

Preferably, the slide has a wall extending from one side of the slide that is located opposite to the direction of the resilient force of the spring. When the slide is positioned at the close position, the wall of the slide contacts a first side of the housing.

Preferably, the housing has a recessed area defined in the first side thereof. The wall is engaged with the recessed area when the slide is positioned at the close position.

Preferably, the housing has a concavity defined in the underside thereof. A resilient member, a positioning member and a restriction member are received in the concavity. The restriction member has a passage, and the positioning member has a narrowed engaging portion which extends through the passage. When the slide is positioned at the close position, the engaging portion is biased by the resilient member and contacts the slide. When the slide is positioned at the open position, the slide is located away from the engaging portion which protrudes beyond the concavity.

Preferably, the engaging portion is a rounded portion.

Preferably, the installation recess has a core received therein. The core has a keyhole which faces the slide. When the slide is positioned at the open position, the slide does not cover the keyhole.

Preferably, the core is a replaceable core. When the slide is positioned at the open position, the slide does not cover the core.

Preferably, the housing is mounted to a lock body which has a core. The core has a keyhole which is located corresponding to the installation recess and faces the slide. When the slide is positioned at the open position, the slide does not cover the keyhole.

The advantages of the present invention are that the housing can be a lock body to which the core is directly installed. Alternatively, the housing can be mounted to a lock body. The resilient member provides a resilient force in the pivoting direction of the slide so that when the slide is not applied by any foreign force, the slide covers the installation recess by the resilient force to prevent rain or dust from entering the core, so that the lock does not get being rusting, fragile or stocked so as to prolong the life of use. When the user wants to unlock the lock, the use applies a force to the slide to make at least one portion of the slide not cover the keyhole of the core so that a key can conveniently inserted into the keyhole to unlock the lock. If the core is a replaceable core, when the slide is positioned at the open position, the slide does not cover the core which can be conveniently replaced.

By the resilient member, the positioning member and the restriction member, when the slide is located at the open position, the slide is removed from the engaging portion, and the engaging portion protrudes beyond the concavity. When the slide is applied by the second resilient force, one side of the slide is restricted by the engaging portion so that the user does not need to continuously apply a force to the slide. This helps the user to conveniently unlock the lock.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
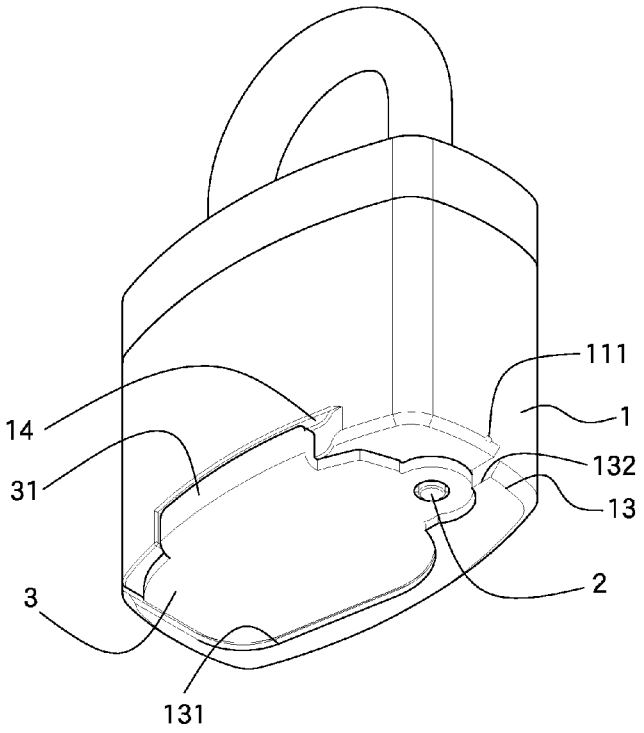
FIG. 1 is a perspective view to show the lock of the present invention.
Figure 2:
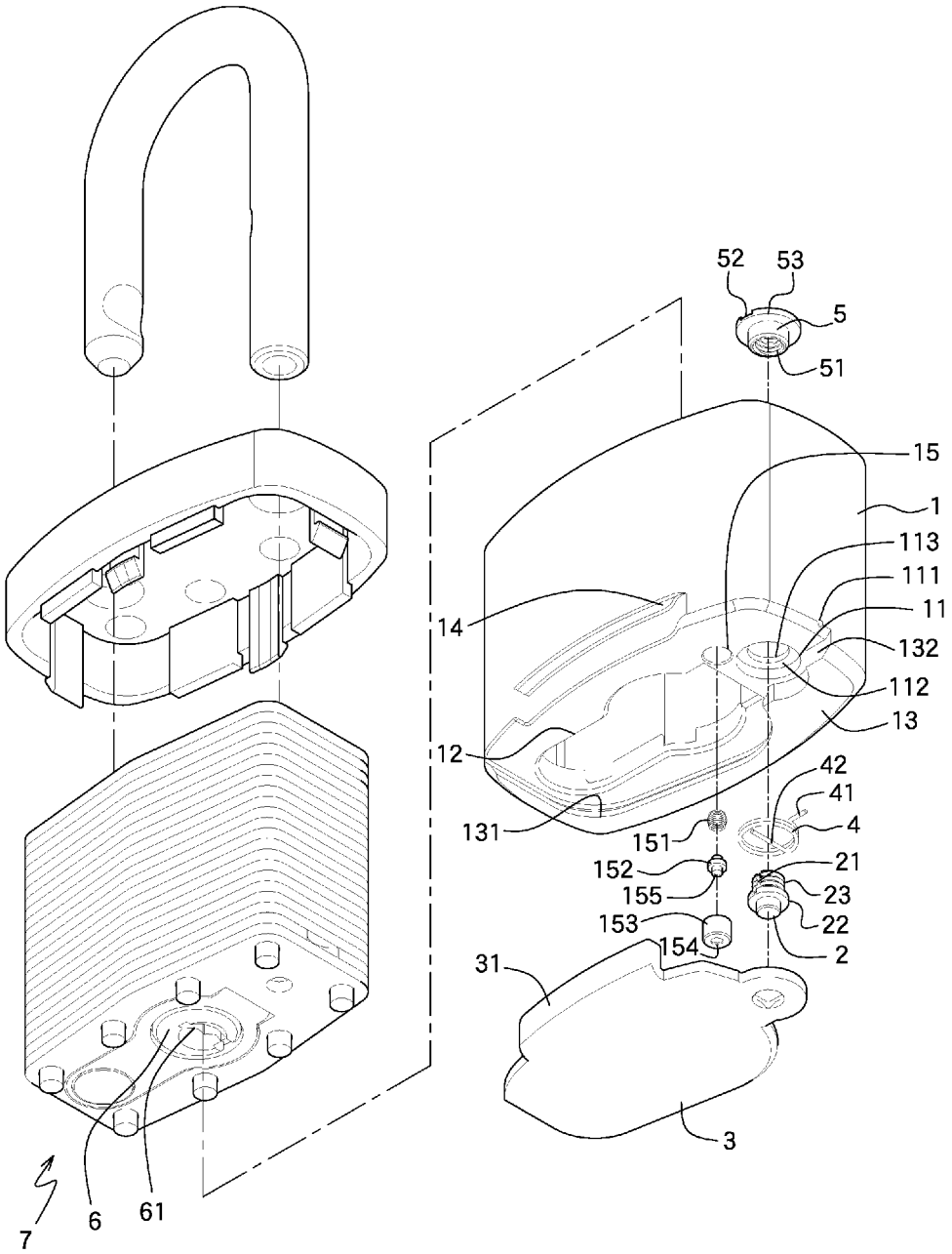
FIG. 2 is an exploded view of the lock of the present invention.

Referring to FIGS. 1 and 2, the lock of the present invention comprises a housing 1 having an insertion hole 11 and an installation recess 12 defined in the underside thereof.

A pivot 2 is located in the insertion hole 11 and has the first end thereof connected with a slide 3.

A spring 4 has the first end thereof connected to the insertion hole 11, and the second end of the spring 4 is connected to the second end of the pivot 2. The spring 4 applies a resilient force along the pivoting direction of the slide 3. In one embodiment, the spring 4 is a torsion spring such as a coil spring to generate the resilient force in the pivoting direction. This is an embodiment and does not restrict the spring of the present invention.

Figure 3:
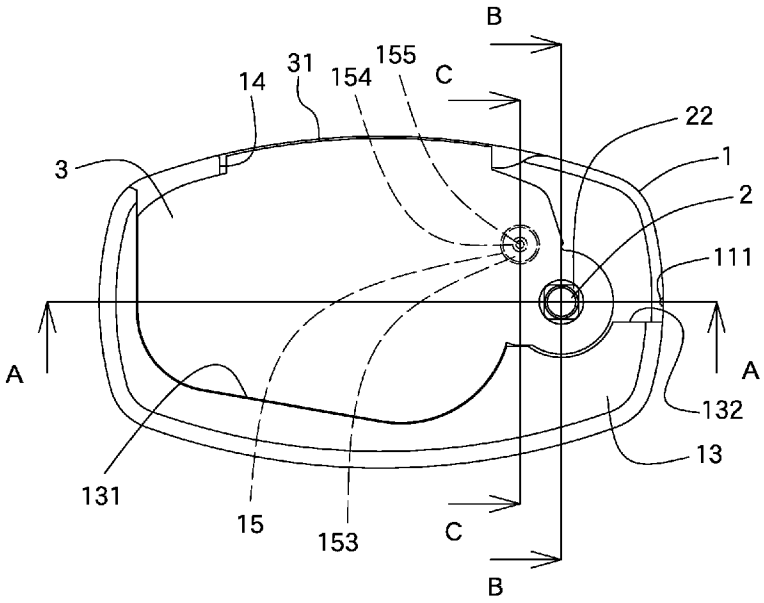
FIG. 3 is a bottom view to show that the slide is positioned at the close position.
Figure 4:
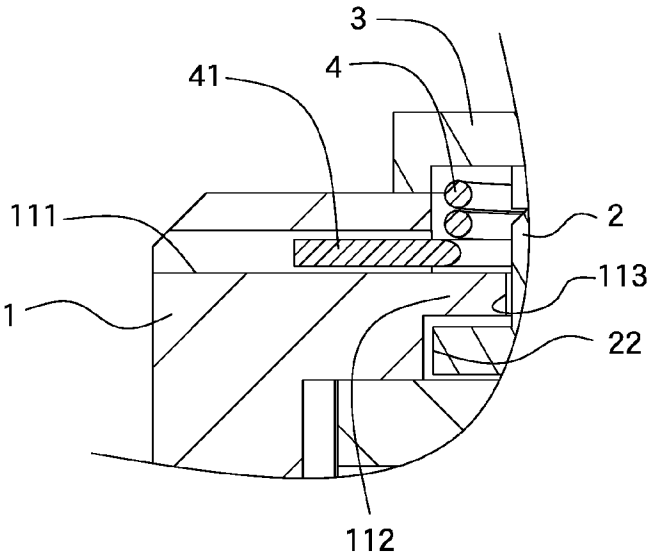
FIG. 4 is a cross sectional view along line A-A in FIG. 3.

A shown in FIGS. 3 and 4, the spring 4 has a first leg 41 on the first end thereof. The insertion hole 11 has a side hole 111 defined therein which communicates outside of the housing 1. The first leg 41 is fixed in the side hole 111 to fix the spring 4 to the insertion hole 11. The spring 4 has a second leg 42 on the second end thereof. The pivot 2 has a slot 21 defined in the second end thereof. The second leg 42 is engaged with the slot 21 to fix the spring 4 to the pivot 2.

In one preferably embodiment, in order to ensure that the second leg 42 is properly engaged with the slot 21, a driving member 5 is connected to the insertion hole 11 from the top of the housing 1. The second end of the pivot 2 is connected to the driving member 5 so as to form a positioning hole 211 between the pivot 2, the driving member 5 and the slot 21 of the pivot 2. The second leg 42 is located in the positioning hole 211.

For the connection between the slide 3, the pivot 2 and the driving member 5, in one embodiment, the pivot 2 has a flange 22 extending radially therefrom. The flange 22 is located close to the first end of the pivot 2. The cover 3 contacts the underside of the flange 22. The pivot 2 has a locking portion 23 formed on the second end thereof. The driving member 5 has a locking hole 51 defined in the first end thereof. The locking portion 23 is connected to the locking hole 51 to connect the pivot 2 to the driving member 5. In one embodiment, the locking portion 23 is threadedly connected to the locking hole 51. The slot 21 is defined axially through the locking portion 23 to securely connect the slide 3, the pivot 2 and the driving member 5 together so that the slide 3 pivots stably.

In one embodiment, the slot 21 is defined in at least one portion of the flange 22, so that the locking portion 23 of the pivot 2 can be completely locked in the locking hole 51. The second leg 42 of the spring is positioned in the slot 21 in the flange 22 so that the locking portion 23 of the pivot 2 does not loose from the locking hole 51 of the driving member 5 due to the pivotable action of the slide 3.

In one embodiment, in order to secure the locking portion 23 of the pivot 2 in the locking hole 51 of the driving member 5, the driving member 5 has a notch 52 defined in the second end thereof, wherein the shape of the notch 52 is designed for being cooperated with a tool such as a screwdriver with a keystone tip.

For the positioning between the insertion hole 11 and the driving member 5, the insertion hole 11 has a support portion 112 formed in the inside thereof. The support portion 112 includes a through hole 113 which communicates with the insertion hole 11. The driving member 5 has a contact portion 53 on the second end thereof, and the contact portion 53 contacts the support portion 112 so that the driving member 5 is positioned in the insertion hole 11.

It is noted that, in one embodiment, the housing 1 is a lock body 7. The lock body 7 has a core 6 and the core 6 has a keyhole 61 which is located corresponding to the installation recess 12 and faces the slide 3. In this embodiment, the housing 1 is mounted to a lock body 7. The lock body 7 has a core 6 and the core 6 has a keyhole 61 which is located corresponding to the installation recess 12 and faces the slide 3. The core 6 is a replaceable core or a fixed core.

Figure 5:
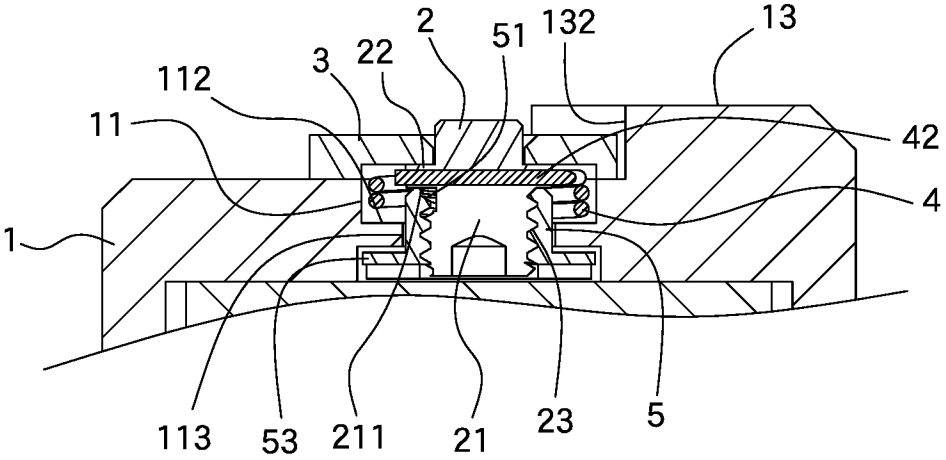
FIG. 5 is a cross sectional view along line B-B in FIG. 3.

As shown in FIGS. 3 to 5, when the slide 3 is positioned at the close position, the slide 3 being applied by only the resilient force of the spring 4, the slide 3 covers the installation recess 12 and is well positioned at the close position. In one embodiment, the housing 1 has a protrusion 13 protruding from the underside thereof. The protrusion 13 has a first end face 131 located corresponding to one side of the slide 3. When the slide 3 is positioned at the close position, one side of the slide 3 contacts the first end face 131.

In another embodiment, the housing 1 does not have the protrusion 13, and the slide 3 has a wall 31 extending from one side thereof and the wall 31 is located opposite to the direction of the resilient force of the spring 4. When the slide 3 is positioned at the close position, the wall 31 of the slide 3 contacts a first side of the housing 1. In order to have an aesthetic appearance for the housing 1, in another embodiment, the housing 1 has a recessed area 14 defined in the first side thereof, and the wall 31 is engaged with the recessed area 14 and does not protrude from the housing 1 when the slide 3 is positioned at the close position. Preferably, the slide 3 has the wall 31, and the housing 1 has the protrusion 13 and the recessed area 14.

Figure 6:
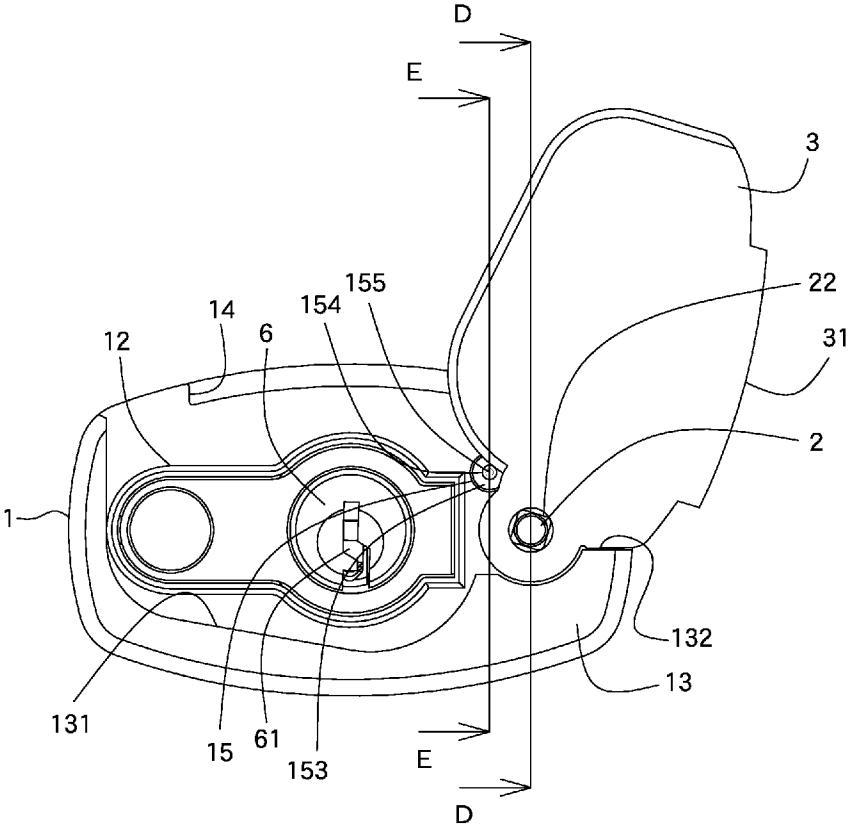
FIG. 6 is a bottom view to show that the slide is positioned at the open position.
Figure 7:
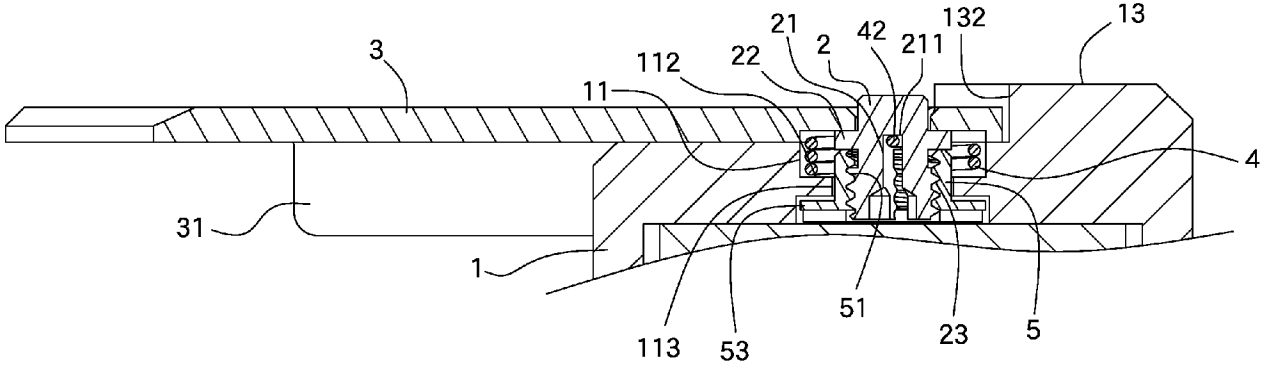
FIG. 7 is a cross sectional view along line D-D in FIG. 6.

As shown in FIGS. 6 and 7, when the user wants to unlock the lock, the user applies a force to the slide 3 in the direction of the resilient force of the spring 4 so as to pivot the slide 3 to the open position, the slide 3 is applied by the force to overcome the resilient force and at least one portion of the slide 3 does not cover the installation hole 12 and the keyhole 61. Therefore, the user can insert a key into the keyhole 61 to unlock the lock.

When the core 6 is a replaceable core, the slide 3 is positioned at the open position, the slide 3 does not cover the core 6 so that the core 6 can be pulled out.

Furthermore, in order to restrict the slide 3 at the open position, in one embodiment, the protrusion 13 has a second end face 132 which faces the first end face 131. When the slide 3 is positioned at the open position, another side of the slide 3 that is located opposite to the direction of the resilient force of the spring 4 contacts the second end face 132.

Figure 8:
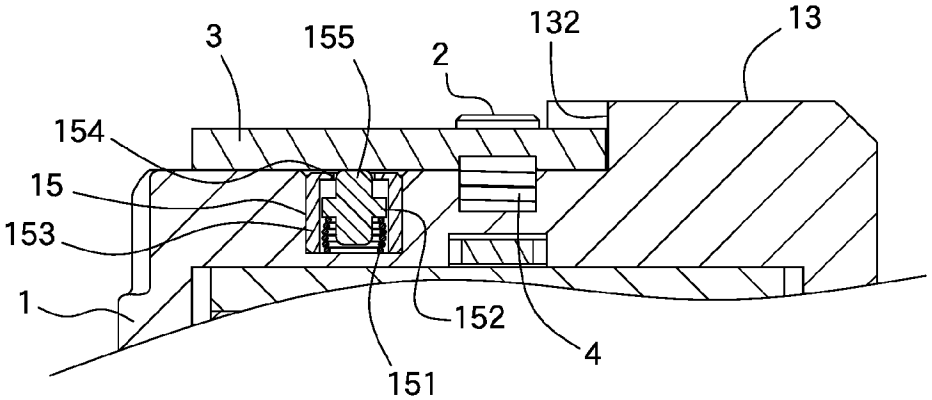
FIG. 8 is a cross sectional view along line C-C in FIG. 3.
Figure 9:
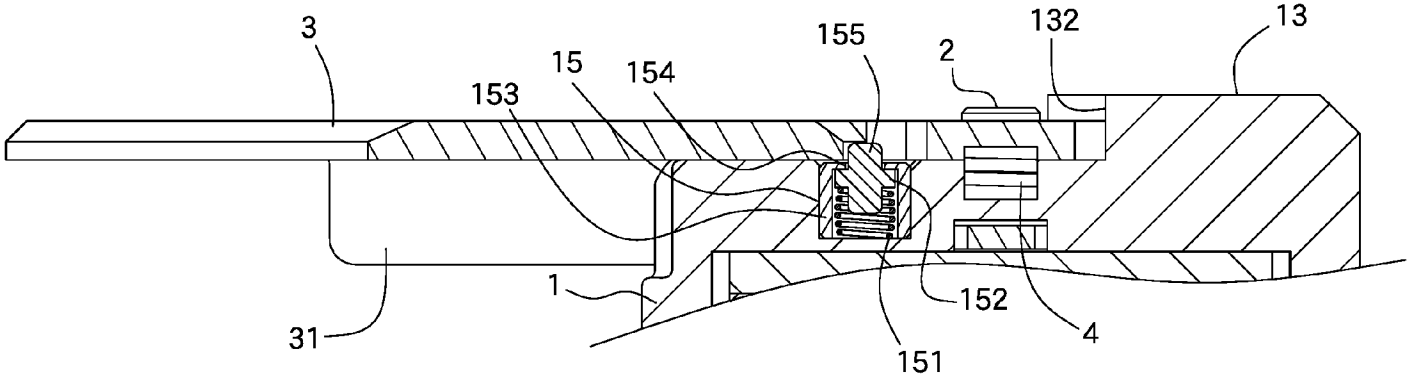
FIG. 9 is a cross sectional view along line E-E in FIG. 6.

In order to allow the user to unlock the lock and the slide 3 is automatically positioned at the open position without continuously applying a force to the slide 3, as shown in FIG. 2, the housing 1 has a concavity 15 defined in the underside thereof. A resilient member 151, a positioning member 152 and a restriction member 153 are received in the concavity 15. The restriction member 153 has a passage 154, and the positioning member 152 has a narrowed engaging portion 155 which extends through the passage 154. As shown in FIGS. 3 and 8, when the slide 3 is positioned at the close position, the engaging portion 155 is biased by the resilient member 151 and contacts the slide 3. As shown in FIGS. 6 and 9, when the slide 3 is positioned at the open position, the slide 3 is located away from the engaging portion 155 which protrudes beyond the concavity 15, so that the slide 3 is not applied by any force from the user and even when the restoring force of the spring 4 is applied to the slide 3, the lateral side of the engaging portion 155 contacts one side of the slide 3 and the slide 3 cannot return to the close position. Therefore, the user does not need to continuously apply a force to the slide 3 to conveniently unlock the lock. When the slide 3 is to be returned to the close position, the user presses the engaging portion 155, or the engaging portion 155 is a rounded portion and the user pushes the engaging portion 155 toward the direction of the resilient force to force the positioning member 152 to overcome the resilient force of the resilient member 152, so that the slide 3 is returned to the close position.

While we have shown and described the embodiment in accordance with the present invention, it should be clear to those skilled in the art that further embodiments may be made without departing from the scope of the present invention.

What is claimed is:

1. A lock comprising:

a housing having an insertion hole and an installation recess defined in an underside thereof;

a pivot located in the insertion hole and having a first end thereof connected with a slide, and a spring having a first end thereof connected within the insertion hole, a second end of the spring connected to a second end of the pivot, the spring applying a resilient force along a pivoting direction of the slide, when the slide is positioned at a close position, the slide being applied by the resilient force of the spring so as to cover the installation recess, when the slide is positioned at an open position, the slide being applied by a force and overcoming the resilient force of the spring, and at least one portion of the slide not covering the installation recess;

wherein the spring has a first leg on the first end thereof, the spring has a second leg on the second end thereof, the pivot has a slot defined in the second end thereof, the second leg is engaged with the slot to fix the spring to the pivot;

a driving member is connected to the insertion hole from a top of the housing, the second end of the pivot is connected to the driving member so as to form a positioning hole between the pivot, the driving member and the slot of the pivot, the second leg is located in the positioning hole;

the pivot has a flange extending radially therefrom, the flange is located close to the first end of the pivot, the slide contacts an underside of the flange; and the pivot has a locking portion formed on the second end thereof, the driving member has a locking hole defined in a first end thereof, the locking portion is connected to the locking hole to connect the pivot to the driving member, the slot is defined axially through the locking portion.

2. The lock as claimed in claim 1, wherein the insertion hole has a side hole defined therein, the first leg is fixed in the side hole to fix the spring to the insertion hole.

3. The lock as claimed in claim 1, wherein the slot is defined in at least one portion of the flange.

4. The lock as claimed in claim 1, wherein the driving member has a notch defined in a second end thereof.

5. The lock as claimed in claim 1, wherein the spring is a torsion spring.

6. The lock as claimed in claim 1, wherein the housing has a protrusion protruding from the underside thereof, the protrusion has a first end face, when the slide is positioned at the close position, one side of the slide contacts the first end face.

7. The lock as claimed in claim 6, wherein the protrusion has a second end face which faces the first end face, when the slide is positioned at the open position, another side of the slide that is located opposite to a direction of the resilient force of the spring contacts the second end face.

8. The lock as claimed in claim 1, wherein the slide has a wall extending from one side of the slide that is located opposite to a direction of the resilient force of the spring, when the slide is positioned at the close position, the wall of the slide contacts a first side of the housing.

9. The lock as claimed in claim 8, wherein the housing has a recessed area defined in the first side thereof, the wall is engaged with the recessed area when the slide is positioned at the close position.

10. The lock as claimed in claim 1, wherein the installation recess has a core received therein, the core has a keyhole which faces the slide, when the slide is positioned at the open position, the slide does not cover the keyhole.

11. The lock as claimed in claim 10, wherein the core is a replaceable core, when the slide is positioned at the open position, the slide does not cover the core.

12. The lock as claimed in claim 1, wherein the housing is mounted to a lock body, the lock body has a core, the core has a keyhole which is located corresponding to the installation recess and faces the slide, when the slide is positioned at the open position, the slide does not cover the keyhole.

13. The lock as claimed in claim 12, wherein the core is a replaceable core, when the slide is positioned at the open position, the slide does not cover the core.

14. A lock comprising:

a housing having an insertion hole and an installation recess defined in an underside thereof;

a pivot located in the insertion hole and having a first end thereof connected with a slide, and a spring having a first end thereof connected within the insertion hole, a second end of the spring connected to a second end of the pivot, the spring applying a resilient force along a pivoting direction of the slide, when the slide is positioned at a close position, the slide being applied by the resilient force of the spring so as to cover the installation recess, when the slide is positioned at an open position, the slide being applied by a force and overcoming the resilient force of the spring, and at least one portion of the slide not covering the installation recess;

wherein the spring has a second leg on the second end thereof, the pivot has a slot defined in the second end thereof, the second leg is engaged with the slot to fix the spring to the pivot;

a driving member is connected to the insertion hole from a top of the housing, the second end of the pivot is connected to the driving member so as to form a positioning hole between the pivot, the driving member and the slot of the pivot, the second leg is located in the positioning hole; and the insertion hole has a support portion formed in an inside thereof, the support portion includes a through hole which communicates with the insertion hole, the driving member has a contact portion on a second end thereof, the contact portion contacts the support portion.

15. A lock comprising:

a housing having an insertion hole and an installation recess defined in an underside thereof;

a pivot located in the insertion hole and having a first end thereof connected with a slide, and a spring having a first end thereof connected within the insertion hole, a second end of the spring connected to a second end of the pivot, the spring applying a resilient force along a pivoting direction of the slide, when the slide is positioned at a close position, the slide being applied by the resilient force of the spring so as to cover the installation recess, when the slide is positioned at an open position, the slide being applied by a force and overcoming the resilient force of the spring, and at least one portion of the slide not covering the installation recess;

wherein the housing has a concavity defined in the underside thereof, a resilient member, a positioning member and a restriction member are received in the concavity, the restriction member has a passage, the positioning member has a narrowed rounded engaging portion which extends through the passage, when the slide is positioned at the close position, the engaging portion is biased by the resilient member and contacts the slide, when the slide is positioned at the open position, the slide is located away from the engaging portion which protrudes beyond the concavity.

* * * * *